US005664353A

United States Patent [19]

Brauer et al.

[11] Patent Number: 5,664,353

[45] Date of Patent: Sep. 9, 1997

[54] METHOD AND ARRANGEMENT FOR OPTICALLY REPRESENTING INFORMATION

[75] Inventors: Bernd Brauer; Michael Schlüter, both of Berlin, Germany

[73] Assignee: M A N Systemelektronik GmbH, Karlsfeld, Germany

[21] Appl. No.: 153,631

[22] Filed: Nov. 17, 1993

[30] Foreign Application Priority Data

Dec. 23, 1992 [DE] Germany ..... 42 44 448.9

[51] Int. Cl.[6] ..... G09F 13/00

[52] U.S. Cl. ..... 40/560; 40/448; 40/624; 353/94

[58] Field of Search ..... 40/448, 547, 560, 40/577, 624; 352/133; 353/94

[56] References Cited

U.S. PATENT DOCUMENTS

| | | | |
|---|---|---|---|
| 1,065,845 | 6/1913 | Sauvage | 40/560 X |
| 3,020,798 | 2/1962 | Chrisman | 40/560 X |
| 3,198,066 | 8/1965 | McGhee | 40/560 X |
| 3,796,484 | 3/1974 | Forster, Jr. | 40/560 X |
| 4,116,553 | 9/1978 | Cohen et al. | 353/94 X |
| 4,330,813 | 5/1982 | Deutsch . | |
| 4,954,935 | 9/1990 | Hammond et al. | 40/560 X |
| 5,011,277 | 4/1991 | Ogino et al. | 353/94 |

FOREIGN PATENT DOCUMENTS

| | | | |
|---|---|---|---|
| 509684 | 3/1954 | Belgium | 40/560 |
| 0 179 913 | 5/1986 | European Pat. Off. . | |
| 0 349 404 | 5/1986 | European Pat. Off. . | |
| 2 607 301 | 5/1988 | France . | |
| 29 24 101 | 1/1980 | Germany . | |
| 30 40 551 | 5/1981 | Germany . | |
| 8124380 | 3/1983 | Germany . | |
| 40 04 739 | 8/1991 | Germany . | |
| 3017615 | 1/1991 | Japan . | |
| 3085879 | 4/1991 | Japan . | |
| WO80/00106 | 1/1980 | WIPO . | |

*Primary Examiner*—Brian K. Green
*Attorney, Agent, or Firm*—McGlew And Tuttle

[57] ABSTRACT

A method and an arrangement for optically representing information on a transparent projection surface using several projection modules and using through-light projection. The method and arrangement are both cost effective and ensures that an observer viewing even a large display of information is provided with a bright, contrast, homogeneous image. Each projection module is formed of a light source with a divergent beam radiating through a controllable light valve and a projection surface arranged behind it. The distance between the light valve and the projection surface is chosen in such a way that the image parts projected by adjacent modules border gaplessly to each other on the projection surface.

2 Claims, 4 Drawing Sheets

METHOD AND ARRANGEMENT FOR OPTICALLY REPRESENTING INFORMATION

FIELD OF THE INVENTION

The present invention relates to a method and an arrangement for optically representing information using a plurality of projection modules on a transparent projection surface by through-light projection.

BACKGROUND OF THE INVENTION

Information is displayed on large areas in the known manner by normal projection with an overhead projector. Because of the necessary magnification involved, the intensity of the direct illumination must be very high. This results in problems with respect to long-term stability and service life.

State of the art developments in liquid crystal display technology also facilitate the provision of large-area display panels, whereby small liquid crystal displays are arranged in matrix form. In this case, the gap size between the small displays determines the resolution of the overall display. The size of the optically not usable areas is determined by the width of the hermetic frame of the individual elements and the width of the electric contacting.

In De 30 40 551 A1, which describes a different display species, it is suggested that these areas can be partially reduced by implementing auxiliary assembly means. Hereby, the supporting plates of the individual liquid crystal display units are joined only on those sides where there are no adjacent display units, for which purpose a resin seal is used. The display electrodes of adjacent display units can be moved closely together.

In yet another different species, DE-40 04 739 A1 describes an optical system for stereoscopically presenting information, with an optical element having a lens function, a light source and an at least partially transparent flat-shaped information carrier, in which two light sources are arranged on that side of the optical element opposing the observer, and where the information carrier is located in the area of the aperture diaphragm of the optical element. In this system, the image is created in the eye of the beholder, so that no projection surface is required. The avoidance of optically not usable zones is not being strived for.

SUMMARY AND OBJECTS OF THE INVENTION

It is an object of the invention to develop a method and an arrangement for optically presenting information, which is both cost effective and ensures that an observer viewing even a large display of information is provided with a bright, contrast, homogeneous image.

According to the invention, a method is provided for optically representing information using several projection modules on a transparent projection surface by through-light projection. The method includes creating from each of the projection modules a shadow projection of an image part on the projection surface. These shadow projections of the image parts are merged gaplessly to form a real total image on the projection surface. According to a further aspect of the method, the respective image parts are magnified by up to 10% by their being respectively shadow-projected on the projection surface.

The invention further comprises a device for implementing the method including a plurality of projection modules wherein each projection module includes a light source with a divergent beam radiating through a controllable light valve. A projection surface is arranged behind the light source whereby the distance between the light valve and the projection surface is chosen in such a way that the image parts projected by the adjacent modules border gaplessly to each other on the projection surface (they do not overlap and there is no gap formed between the projected image part. The light source may be the output of the optical wave guide or a halogen spot lamp. The controllable light valve is preferably a liquid crystal cell. The projection surface is a diffusing surface preferably formed of a foil. The diffusing surface can also be formed of opal glass. The projection surface is preferably formed of a sandwich combination of diffusing surfaces and fresnel lenses. There is preferably a mask arranged between the light source and the light valve in the plane of the light valve. The projection modules may be arranged in rows and columns.

By utilizing the magnifying effect of a shadow projection in the divergent course of a beam from a light source, it is achieved that the real parts of the image which are created on a projection surface per projection module are merged in such a way that a gapless total image is obtained on the projection surface. The distance between a light valve, for example a liquid crystal cell, and the projection surface, i.e. the projection distance, is chosen in dependence of the existing optically not usable perimeter of the liquid crystal cell, the opening angle of the light source, e.g. an optical waveguide, and the required magnification, and is chosen in such a way that the approximately 10% enlarged shadow images coming from the liquid crystal cells are joined in such a way that the unactivated perimeter areas of the liquid crystal cells are blended out while the activated areas of the liquid crystal cells are enlarged to merge gaplessly on the projection area. Since the necessary enlargement is generally less than 10%, it is possible to do without further optical aids. To an observer viewing the image from a distance, as is usually the case with large-scale projections, a slight decrease in sharpness is insignificant. This method provides a liquid-crystal-cell based compact and cost efficient projection system for large-surface information display, with which an homogeneous real image can be obtained on a light-diffusing projection surface and where the boundaries of the individual modules are not visible.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
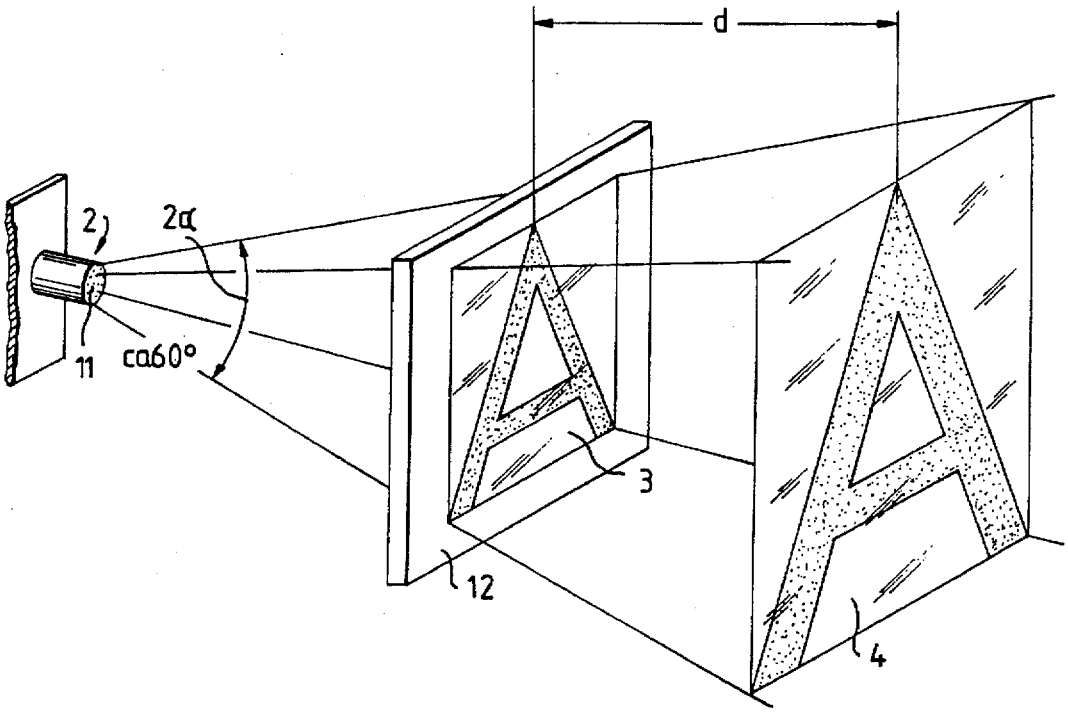
FIG. 1 is a schematic perspective view of a projection module.

To clarify the principle involved in the projection technique for widening the image, FIG. 1 shows the perspective view of a projection module 1. The projection module 1 includes of a light source 2 having a defined radiation characteristic 2*a* for back-lighting the information which is to be displayed and a light valve. In the present example, the light source 2 consists of an optical fiber bundle having a radiation characteristic 2*a* of approximately 60°. The radiation characteristic 2*a* is the effective opening angle of an optical fiber and is determined from the half-field-strength beam width of the measured angle-dependent radiation distribution at the output of the optical fiber, when the optical fiber input is being illuminated with a Lambert radiator. The light source 2 radiates through a liquid crystal cell 3 which has a circumferential contacting edge or frame 12. The liquid crystal cell 3 acts as a light valve and contains the information to be displayed. The diffusing projection surface 4 forms the viewing plane on to which the magnified information is projected. The projection distance d between the projection surface 4 and the liquid crystal cell 3 depends on the magnification factor required.

Figure 2:
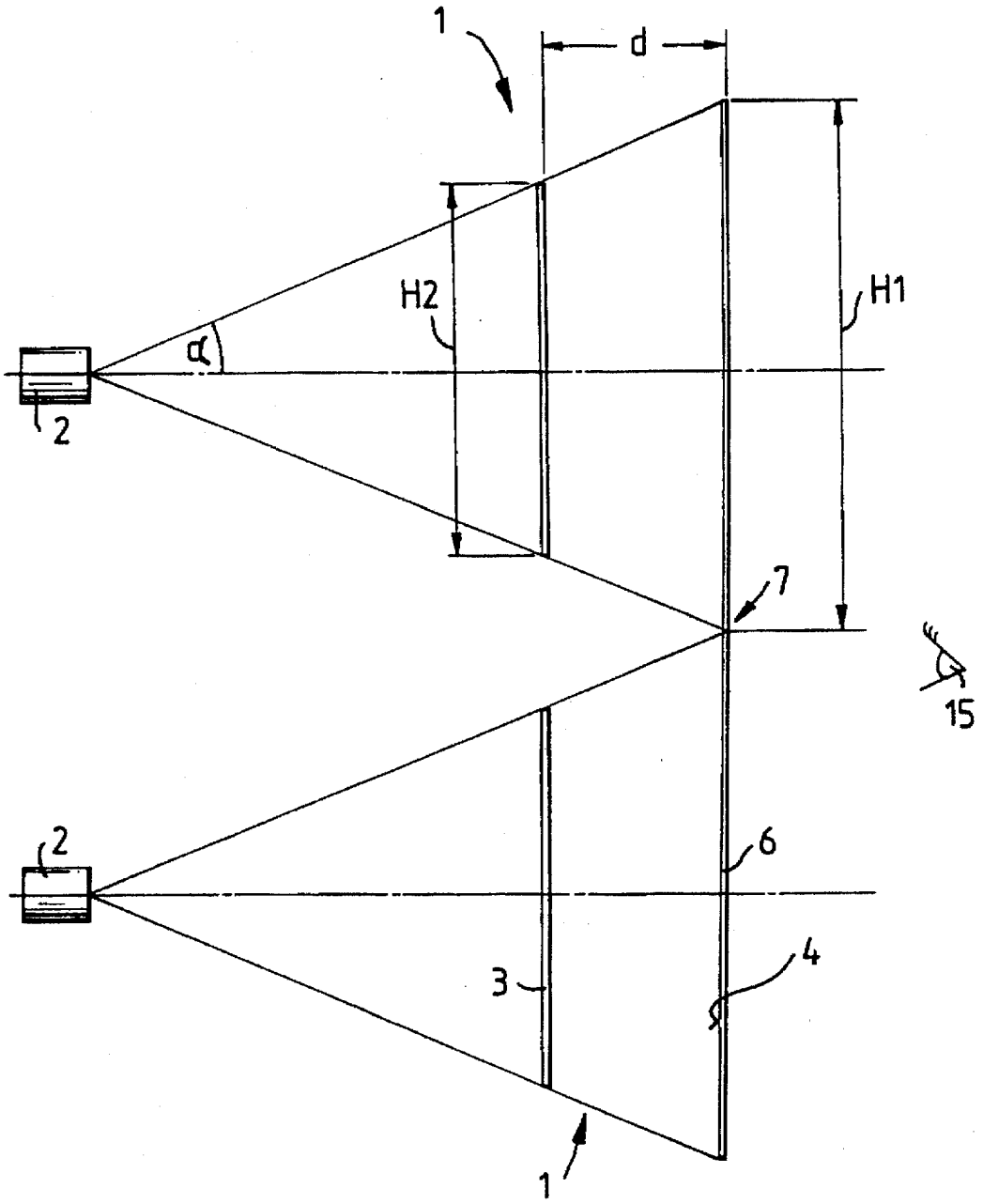
FIG. 2 is a schematic side elevation of two adjacent projection modules.

FIG. 2 shows two adjacent projection modules 1. The figure serves to illustrate the interrelationships which must be observed when several projection modules are to be used to produce a gap-free overall image of information to be displayed. The light sources 2 each have an opening angle of approximately 60° and each radiate through a liquid crystal cell 3 which each have a height of H2 and which contain parts of the information which is to be displayed. When an approximately 10% enlargement of the image part 6 is to be obtained on the projection surface, and when both image parts 6 of each liquid crystal cell 3 are to merge gaplessly, then the distance d between the liquid crystal cells 3 and the projection surface 4 having the respective height H1 is expressed as follows:

$$d = \frac{H1 - H2}{2 \tan\alpha}$$

whereby H1=1.1×H2, 2α=60° are chosen. In practice, a projection distance d of approximately 5 mm has proved successful.

Figure 3:
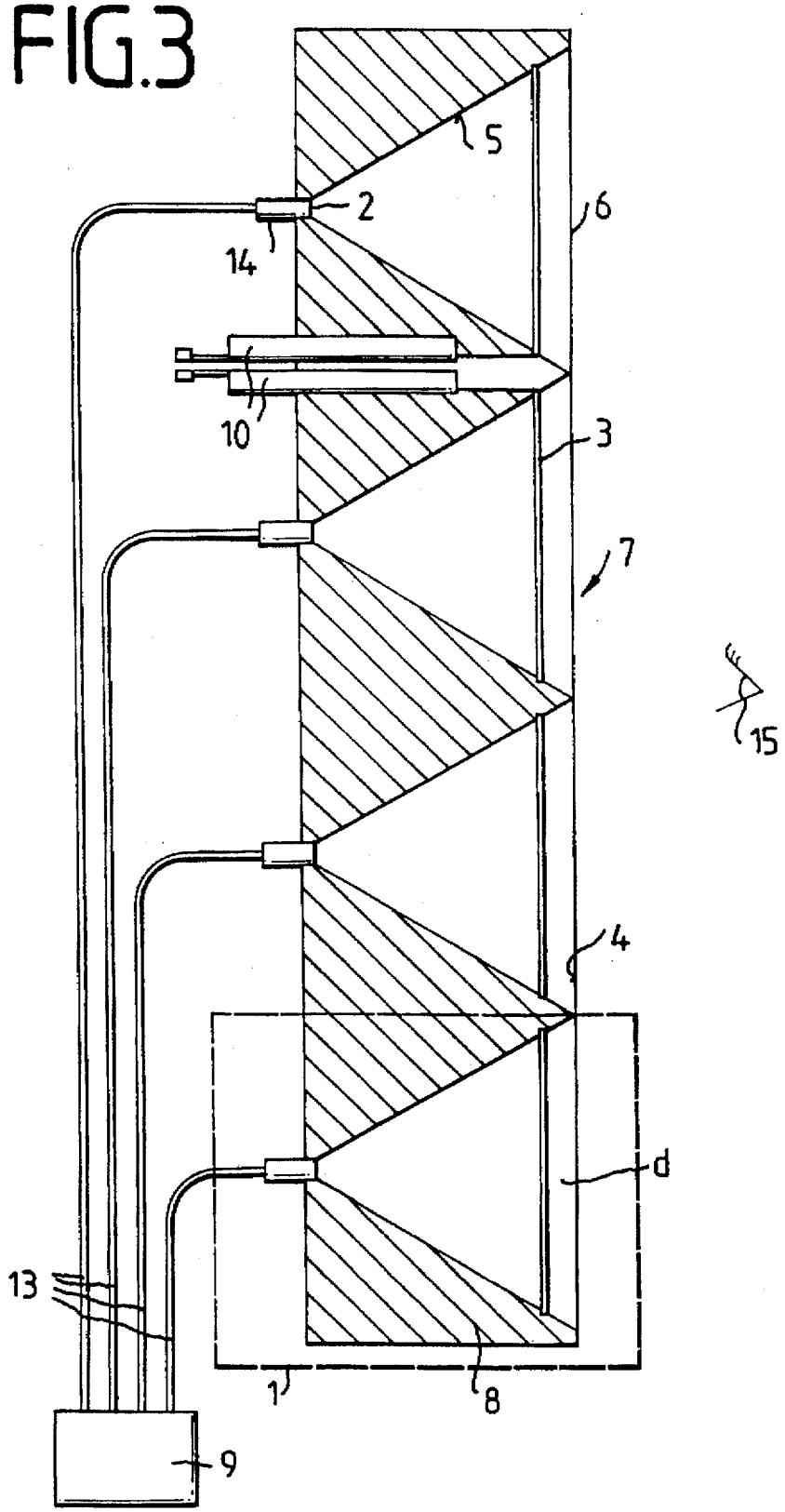
FIG. 3 is a schematic side elevation of an arrangement comprising several projection modules.
Figure 4:
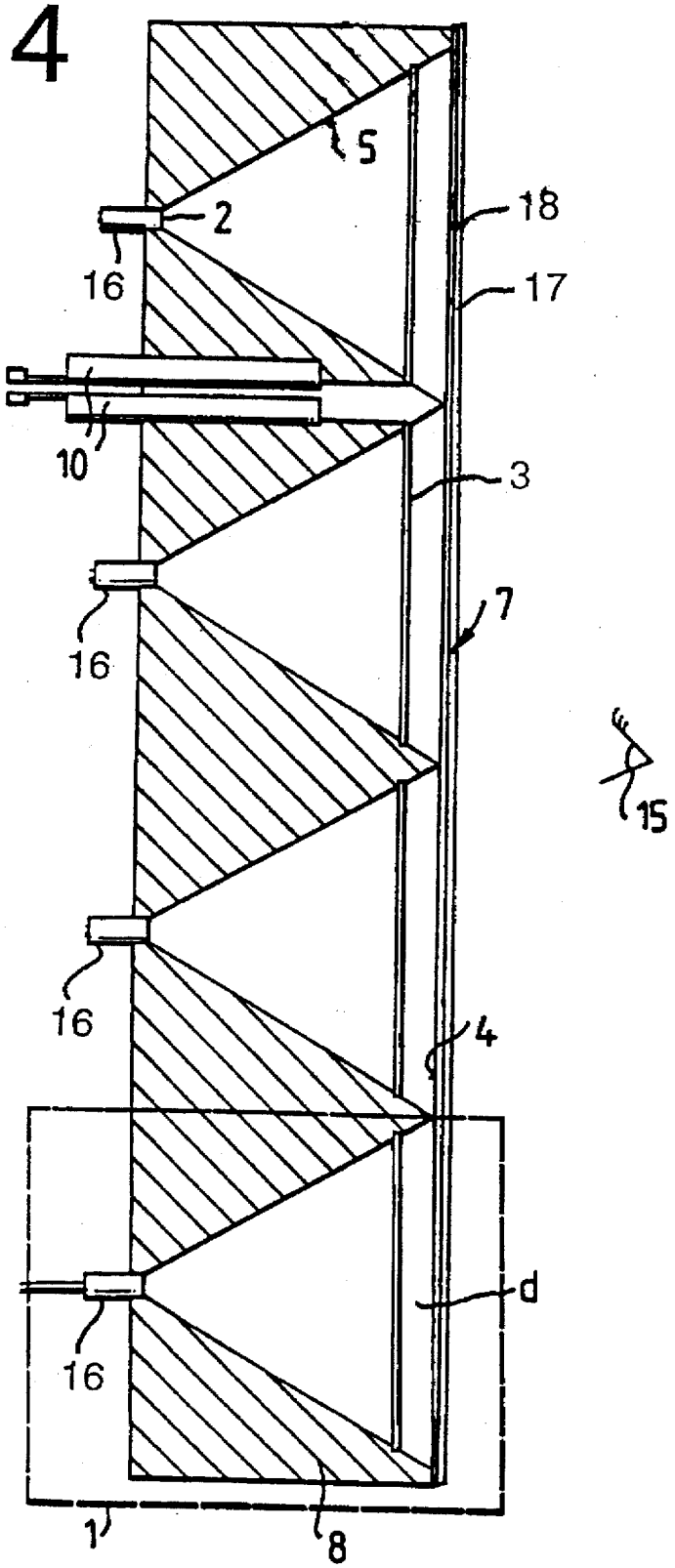
FIG. 4 is a schematic side elevational showing a halogen spot lamp and a combined diffusing surface and Fresnel lens.

The method uses the enlarging effect of a shadow projection in a diverging beam coming from a source of light. The light source 2 of each individual module 1 used must meet this requirement, i.e. besides the optical fiber outputs described it is also possible to use halogen spot lamps 16, as shown in FIG. 4, with a defined radiation characteristic. The projection surface 4 arranged between the light source 2 and the observer 15 must be a diffusing surface, e.g. a matt viewing screen. The diffusing characteristic can be improved considerably by using thin, white-colored glasses or foils (opal effect). This effect can also be achieved by combining a diffusing surface 17 with a Fresnel lens 18, as shown in FIG. 4. To decouple the beam paths of the adjacent modules 1, it is favorable to arrange a mask 5 into the respective plane of the control element, here the liquid crystal cells 3. In FIG. 3 the mask is embodied by the inner slope of the housing 8. Since the magnification required is generally less than 10%, it is possible to do without further optical aids. To an observer viewing the image from a distance, as is usually the case with large-scale projections, a slight decrease in sharpness is insignificant.

FIG. 3 shows an arrangement of four projection modules 1, as they are required for a large-area information display. Each projection module 1 is fed light from a central light source unit 9 via flexible optical fibers 13 leading into polished tails 14 and form the light source 2. The light exists from these tails 14 at a defined angle 2*a* and radiates through the respective light valve, in this case liquid crystal cells 3, so that the partial projections of the image parts 6 are projected on to the projection surface arranged at a defined distance d from the light valves, so that the observer 15 sees a homogenous total image 7. The individual projection modules 1 are combined in a housing 8. The light valves, in this case the liquid crystal cells 3, are controlled via an electronic control circuit 10.

While a specific embodiment of the invention has been shown and described in detail to illustrate the application of the principles of the invention, it will be understood that the invention may be embodied otherwise without departing from such principles.

What is claimed is:

1. An arrangement for optically representing information, the arrangement comprising:

a plurality of light sources producing a diverging light beam;

a plurality of controllable light valve means, each of said light valve means controlling passage of said diverging light beam from a separate one of said plurality of light sources through said each light valve means to form a respective image part;

a projection surface arranged on a side of said plurality of light valve means diametrically opposite said plurality of light sources, said projection surface being spaced from said plurality of light valve means by a chosen distance such that edges of said image parts formed by adjacent light valve means abut each other on said projection surface;

a mask extending from each of said plurality of light sources to said projection surface.

2. An arrangement in accordance with claim 1, wherein:

said mask forms a substantially constantly diverging light passage from said light source to said projection surface, said diverging light passage being substantially equal to a divergence of said diverging light beam of each of said light sources.

* * * * *